US010546455B2

(12) United States Patent
Azuma et al.

(10) Patent No.: US 10,546,455 B2
(45) Date of Patent: Jan. 28, 2020

(54) GAME MACHINE, GAME CONTROL METHOD, AND COMPUTER READABLE STORAGE MEDIUM

(71) Applicant: KONAMI DIGITAL ENTERTAINMENT CO., LTD., Tokyo (JP)

(72) Inventors: Shogo Azuma, Tokyo (JP); Shinya Ito, Tokyo (JP); Junichi Yamaguchi, Tokyo (JP)

(73) Assignee: KONAMI DIGITAL ENTERTAINMENT CO., LTD., Tokyo (JP)

( * ) Notice: Subject to any disclaimer, the term of this patent is extended or adjusted under 35 U.S.C. 154(b) by 759 days.

(21) Appl. No.: 15/054,018

(22) Filed: Feb. 25, 2016

(65) Prior Publication Data

US 2016/0180642 A1 Jun. 23, 2016

Related U.S. Application Data

(63) Continuation of application No. PCT/JP2014/072479, filed on Aug. 27, 2014.

(30) Foreign Application Priority Data

Sep. 25, 2013 (JP) ..... 2013-198948

(51) Int. Cl.
*G07F 17/32* (2006.01)
*A63F 3/06* (2006.01)
(Continued)

(52) U.S. Cl.
CPC ..... *G07F 17/3216* (2013.01); *A63F 3/0645* (2013.01); *A63F 5/0088* (2013.01);
(Continued)

(58) Field of Classification Search
None
See application file for complete search history.

(56) References Cited

U.S. PATENT DOCUMENTS

2005/0159205 A1* 7/2005 Kukita ..... A63F 3/0645 463/17
2006/0012117 A1* 1/2006 Uchiyama ..... G07C 15/001 273/142 R
(Continued)

FOREIGN PATENT DOCUMENTS

JP 2004097487 A 4/2004
JP 2007301300 A 11/2007
(Continued)

OTHER PUBLICATIONS

English Translation of Chinese Office Action with Original Chinese Office Action (CN Pat. Appln. No. 201480049818.0); dated Jul. 31, 2018.
(Continued)

*Primary Examiner* — Tramar Y Harper
(74) *Attorney, Agent, or Firm* — Howard & Howard Attorneys PLLC

(57) ABSTRACT

A game machine comprises: a lottery mechanism where a plurality of pockets, each being correlated to each choice, are provided so that at least one choice is selected from a plurality of choices, and a lottery that by making a ball enter any one of the plurality of pockets, the choice correlated to the pocket is selected is executed; and a discharging mechanism which discharges a ball to the lottery mechanism, wherein the discharging mechanism is controlled so that at least one ball is discharged to the lottery mechanism as one lottery unit, and further controlled so that the game body is discharged continuously to repeat the lottery by the lottery unit, as long as a predetermined end condition is not established.

11 Claims, 14 Drawing Sheets

(51) Int. Cl.
*A63F 5/00* (2006.01)
*G07C 15/00* (2006.01)

(52) U.S. Cl.
CPC ..... *G07C 15/001* (2013.01); *G07F 17/3202* (2013.01); *G07F 17/329* (2013.01); *G07F 17/3213* (2013.01); *G07F 17/3297* (2013.01)

(56) References Cited

U.S. PATENT DOCUMENTS

2007/0057451 A1* 3/2007 Halliburton ..... A63F 5/02 273/138.1
2007/0265057 A1 11/2007 Yoshizawa
2009/0181747 A1* 7/2009 Nagano ..... G07F 17/32 463/17
2010/0102507 A1* 4/2010 Bontempo ..... A63F 5/00 273/142 R
2010/0279757 A1* 11/2010 Glenn, II ..... G07F 17/3211 463/17
2012/0202575 A1 8/2012 Matsuno
2014/0094280 A1* 4/2014 Berman ..... G07F 17/326 463/25

FOREIGN PATENT DOCUMENTS

JP 2011067534 A 4/2011
JP 2011239965 A 12/2011
JP 5899177 B 4/2016

OTHER PUBLICATIONS

International Search Report dated Nov. 11, 2014 for International Application No. PCT/JP2014/072479.
Notification to Grant a Patent Right for Invention (CN Application No. 201480049818.0); dated Apr. 4, 2019; Includes English Translation; 3 pages.

* cited by examiner

GAME MACHINE, GAME CONTROL METHOD, AND COMPUTER READABLE STORAGE MEDIUM

CROSS-REFERENCE TO RELATED APPLICATION

This application is a continuation of PCT Application No. PCT/JP2014/072479, filed Aug. 27, 2014, which claims priority to Japanese Patent Application No. 2013-198948, filed Sep. 25, 2013, the disclosures of which are hereby incorporated by reference in their entirety.

TECHNICAL FIELD

The present invention relates to a game machine and the like having a lottery mechanism.

BACKGROUND ART

There is known to be some game machines each having a lottery mechanism. For example, there is known to be a game machine having a physical lottery mechanism for a bingo game, where a ball is discharged to a roulette wheel having a plurality of pockets, to each of which a numeral is assigned, and when the ball enters one of the pockets, the numeral is selected (for example, patent literature 1).

CITATION LIST

Patent Literature

Patent Document #1: JP-A-2004-97487

SUMMARY OF INVENTION

Technical Problem

The number of times that the lottery is executed in one game is predetermined, and when the predetermined number of lotteries ends, the game also ends. In this case, since it is easy to estimate the result in the middle of the game, the interest of the game is probably reduced.

With that background, the present invention aims to provide a game machine and the like where the moment when a game ends changes depending on a lottery result.

Solution to Problem

A game machine as one aspect of the present invention is a game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; a discharging mechanism which discharges at least one game body to the lottery mechanism; and a computer, wherein the computer functions by executing a computer program, as a discharging control device which is configured to control the discharging mechanism so that at least one game body is discharged to the lottery mechanism as one lottery unit, and have a continuous discharging control device which is configured to control the discharging mechanism so that the at least one game body is discharged continuously to repeat the lottery by the lottery unit, as long as a predetermined end condition is not established.

A game control method as another aspect of the present invention is a game control method for making a computer of a game machine function, the game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; and a discharging mechanism which discharges at least one game body to the lottery mechanism, wherein the game control method making the computer execute a discharging control step of controlling the discharging mechanism so that at least one game body is discharged to the lottery mechanism as one lottery unit, and in the discharging control step, further execute a continuous discharging control step of controlling the discharging mechanism so that the at least one game body is discharged continuously to repeat the lottery by the lottery unit, as long as a predetermined end condition is not established.

A non-transitory computer readable storage medium as another aspect of the present invention is a non-transitory computer readable storage medium storing a computer program for making a computer of a game machine function, the game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; and a discharging mechanism which discharges at least one game body to the lottery mechanism, wherein the computer program makes the computer function as a discharging control device which is configured to control the discharging mechanism so that at least one game body is discharged to the lottery mechanism as one lottery unit, and further makes the computer as the discharging control device function as a continuous discharging control device which is configured to control the discharging mechanism so that the at least one game body is discharged continuously to repeat the lottery by the lottery unit, as long as a predetermined end condition is not established.

DESCRIPTION OF EMBODIMENTS

Figure 1:
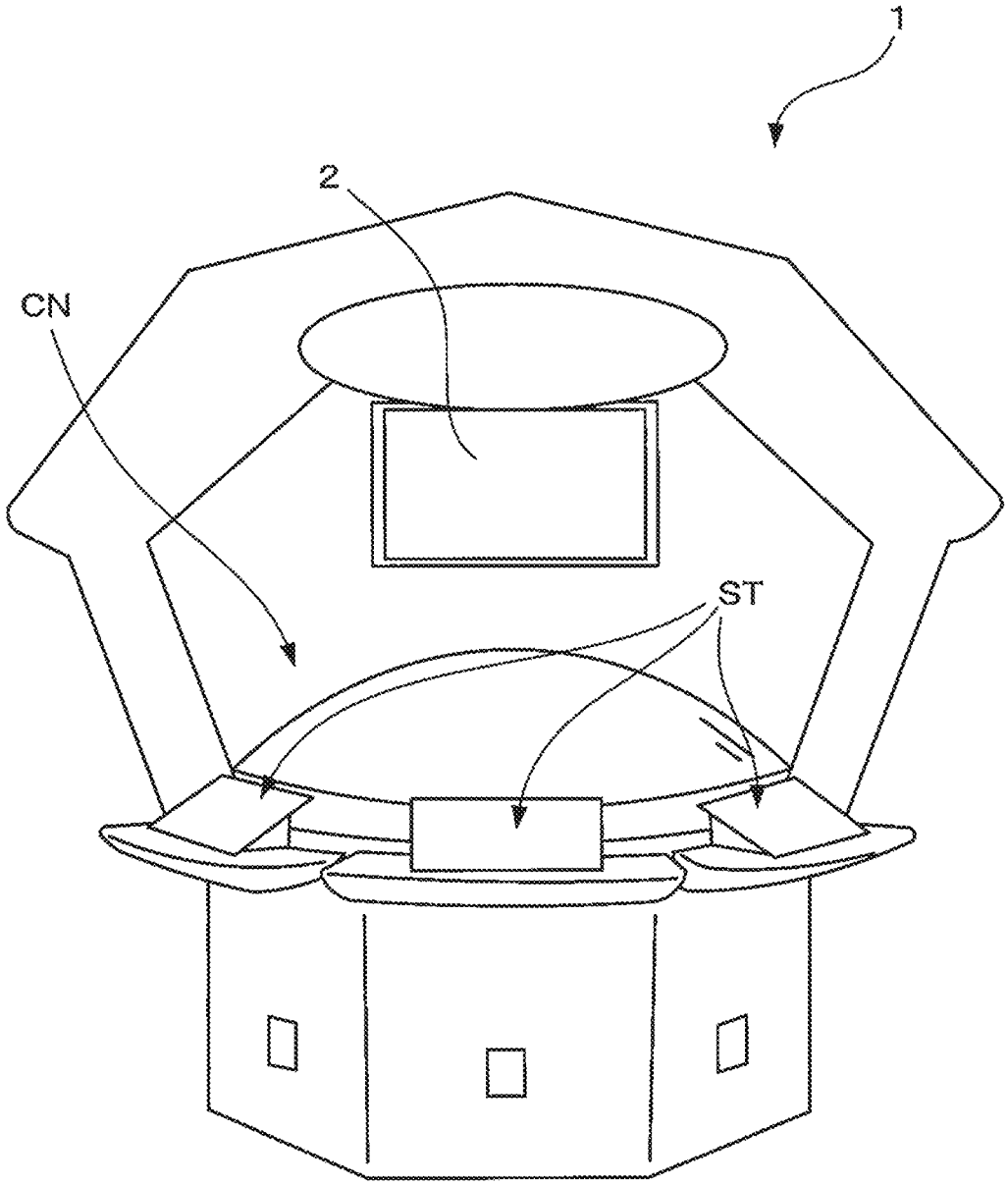
FIG. 1 is a diagram showing a whole game machine according to one embodiment of the present invention.

FIG. 1 is an overall view of a game machine according to one embodiment of the present invention. The game machine 1 is configured as a game machine for commercial use (business use) where a user is allowed, in exchange of a predetermined game-play fee, to play a game within a range corresponding to the game-play fee. Such a game machine 1 is sometimes called an arcade game machine. The game machine 1 is installed to a predetermined facility such as a store mainly for increasing a receipt by making a lot of users play games repeatedly.

The game machine 1 is a so-called medal game machine where a medal is used as a game medium. The game machine 1 comprises a center unit CN and a plurality of station units ST which are disposed so as to surround the circumference of the center unit CN. Further, the game machine 1 is provided with a center monitor 2 being located above the center unit CN. The center monitor 2 displays various images relating to a game served by the game machine 1. TO the center monitor 2, for example, a liquid crystal display device is applied.

Figure 2:
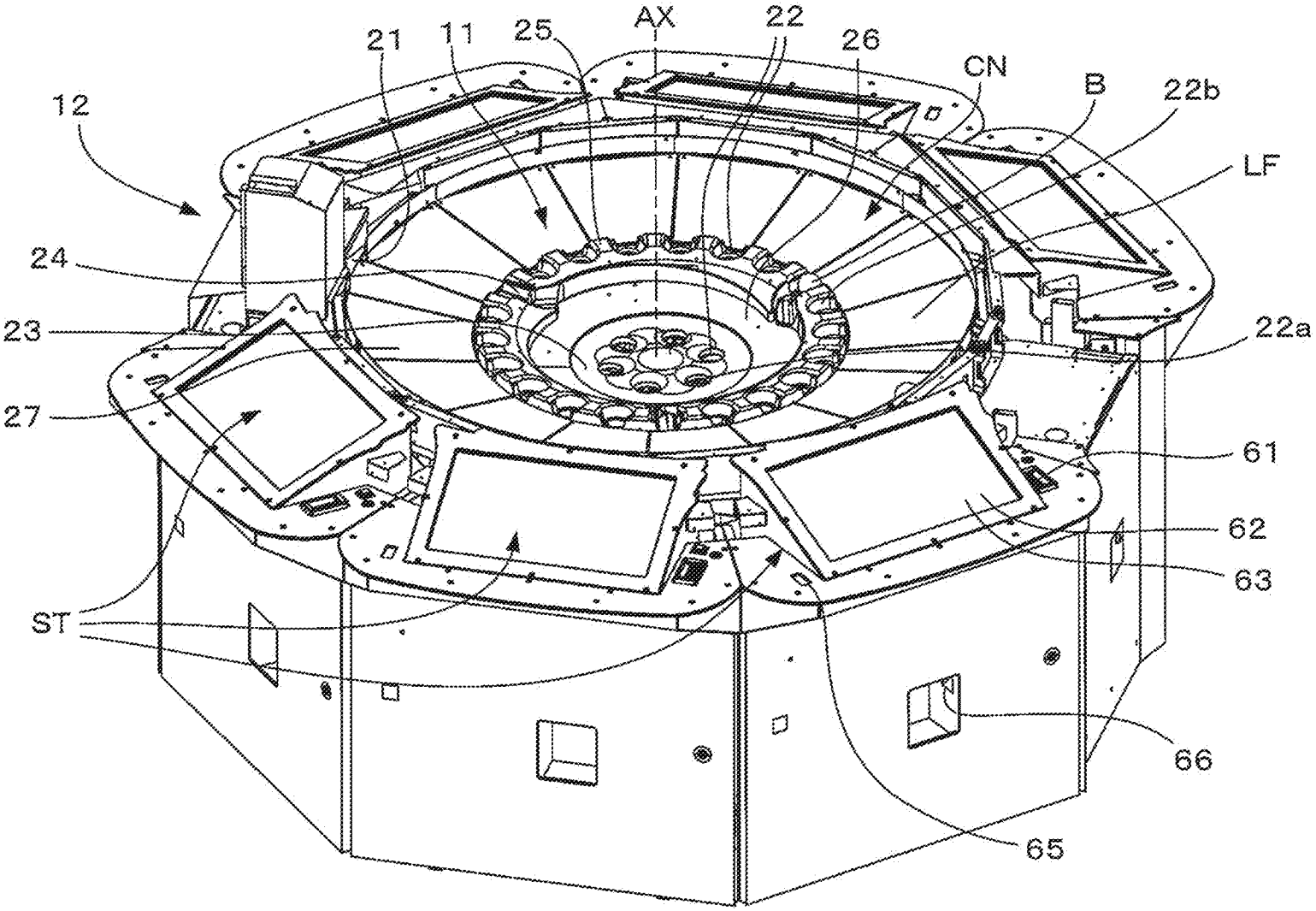
FIG. 2 is a perspective view of a center unit and plural station units.

FIG. 2 is a perspective view of the center unit CN and the plurality of station units ST. In FIG. 2, a part of armoring of the game machine 1 is omitted for the purpose of illustration. The center unit CN is provided with: a lottery mechanism 11 which selects at least one choice from a plurality of choices; a discharging mechanism 12 which discharges at least one ball B as a game body into the lottery mechanism; a retrieval mechanism 13 (illustrated in FIG. 5) which retrieves the balls B. The lottery mechanism 11 is a roulette type lottery mechanism where the balls B are discharged to a lottery field LF, and when the ball B enters any one of a plurality of pockets 22, each pocket 22 is correlated to each choice, the choice corresponding to the pocket 22 which the ball B has entered is selected. As the choices, for example, a plurality of colors (five colors of red, yellow, green, light blue, and blue) are set, each of the five colors is assigned to each pocket 22 in a predetermined order. In the present embodiment, each of the five colors is assigned to each three pockets 22. Each color corresponds to plural kinds of attribution.

The lottery mechanism 11 is provided with the lottery field LF where the lottery is executed; and a ball slot 21 from which the balls B supplied from the discharging mechanism 12 are discharged. The lottery field LF is provided with a first lottery portion 23; a second lottery portion 25; a rotational field 26 as a rotational portion; and a ball moving field 27. The first lottery portion 23, where a part of the plurality of pockets 22 (sometimes referred to as the pocket(s) 22*a*) are arranged in the circumferential direction, is driven to rotate around an axial line AX. The second lottery portion 25, where the remaining pockets 22 (sometimes referred to as the pocket(s) 22*b*) and at least one guiding passage 24 which leads the ball B to the first lottery portion 23 are arranged so as to surround the circumference of the first lottery portion 23, is driven to rotate integrally with the first lottery portion 23. The rotational field 26 is located between the first lottery portion 23 and the second lottery portion 25, and driven to rotate around the axial line AX in a direction opposite to the direction where the first lottery portion 23 and second lottery portion 25 rotate. The ball moving field 27 is provided so as to surround the circumference of the second lottery portion 25.

Figure 3:
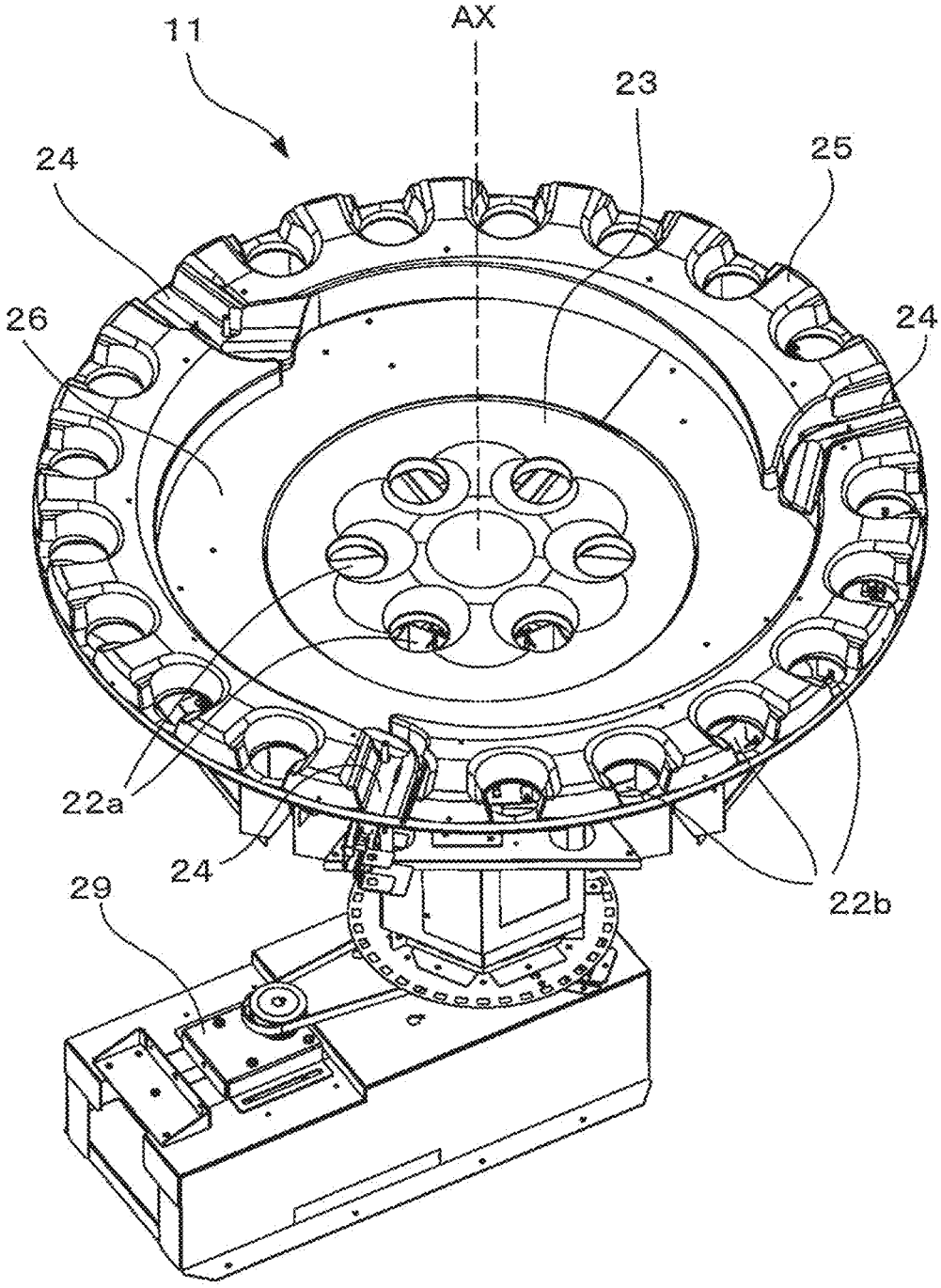
FIG. 3 is a main part enlarged view of a lottery mechanism.
Figure 4:
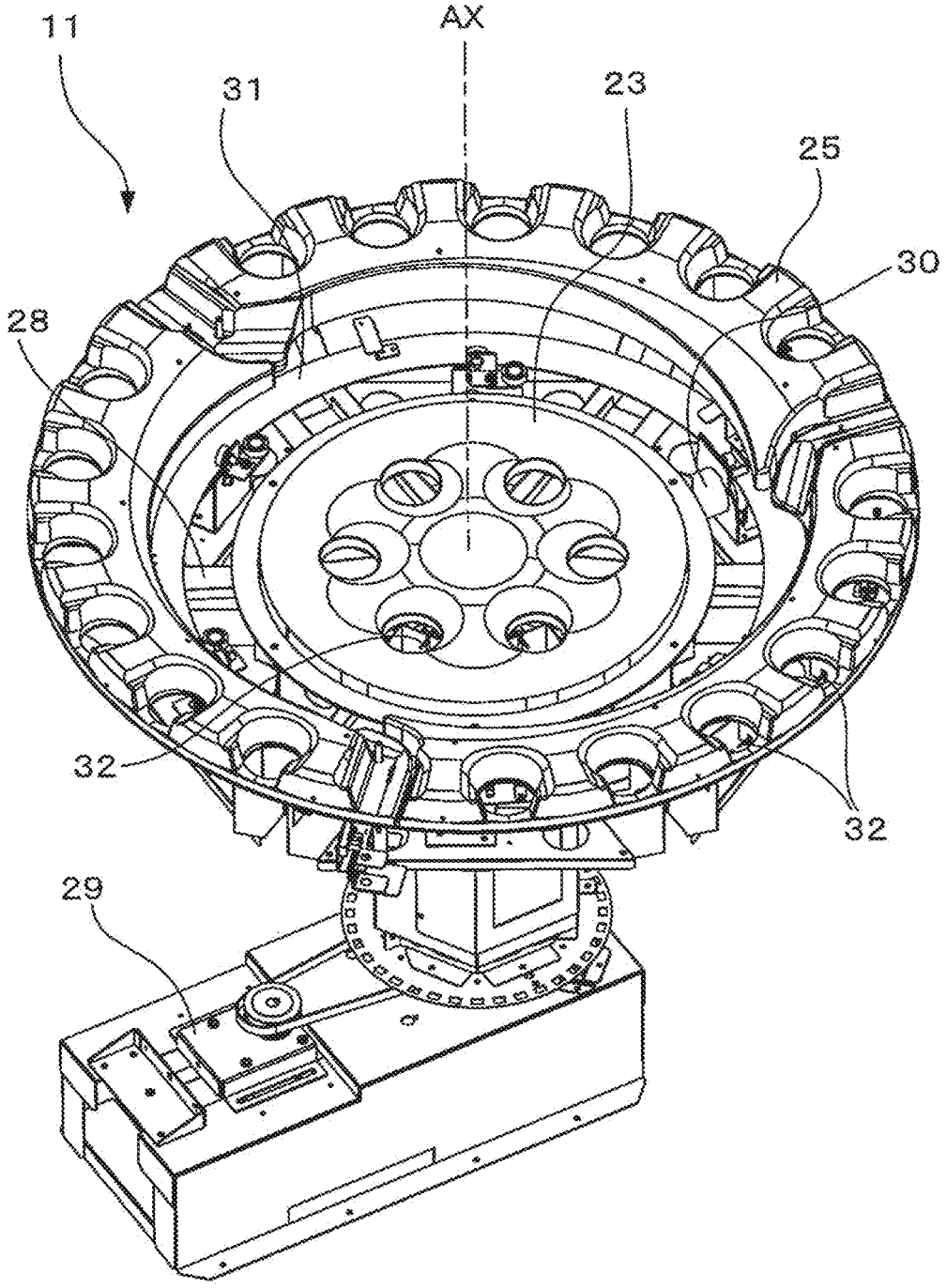
FIG. 4 is a diagram where a rotational field of FIG. 3 is omitted.

FIG. 3 is a main part enlarged view of the lottery mechanism 11. FIG. 4 is a diagram showing a state that the rotational field 26 of FIG. 3 is omitted. The lottery mechanism 13 is further provided with a supporting mechanism 28 for supporting the first lottery portion 23 and the second lottery portion 25; and a drive source 29 for rotatively driving the supporting mechanism 28. The drive source 29 rotates a drive shaft (not illustrated) extending along the axial line AX. The supporting mechanism 28 is fixed to the drive shaft, and when the supporting mechanism 28 rotates, thereby the first lottery portion 23 and second lottery portion 25 rotate integrally with each other. To the supporting mechanism 28, a drive source 30 for rotatively driving the rotational field 26 is fixed. The drive force 30 rotates the rotational field 26, by rotating a transmission member 31 fixed to the rotational field 26. Therefore, the rotational field 26 is capable of rotating independently of the first lottery portion 23 and second lottery portion 25. In the present embodiment, the rotational field 26 is driven in a direction opposite to the lottery portions 23 and 25. To the drive source 30, power is supplied using well known technology such as a slip ring. The ball moving field 27 is fixed to the game machine 1.

Figure 5:
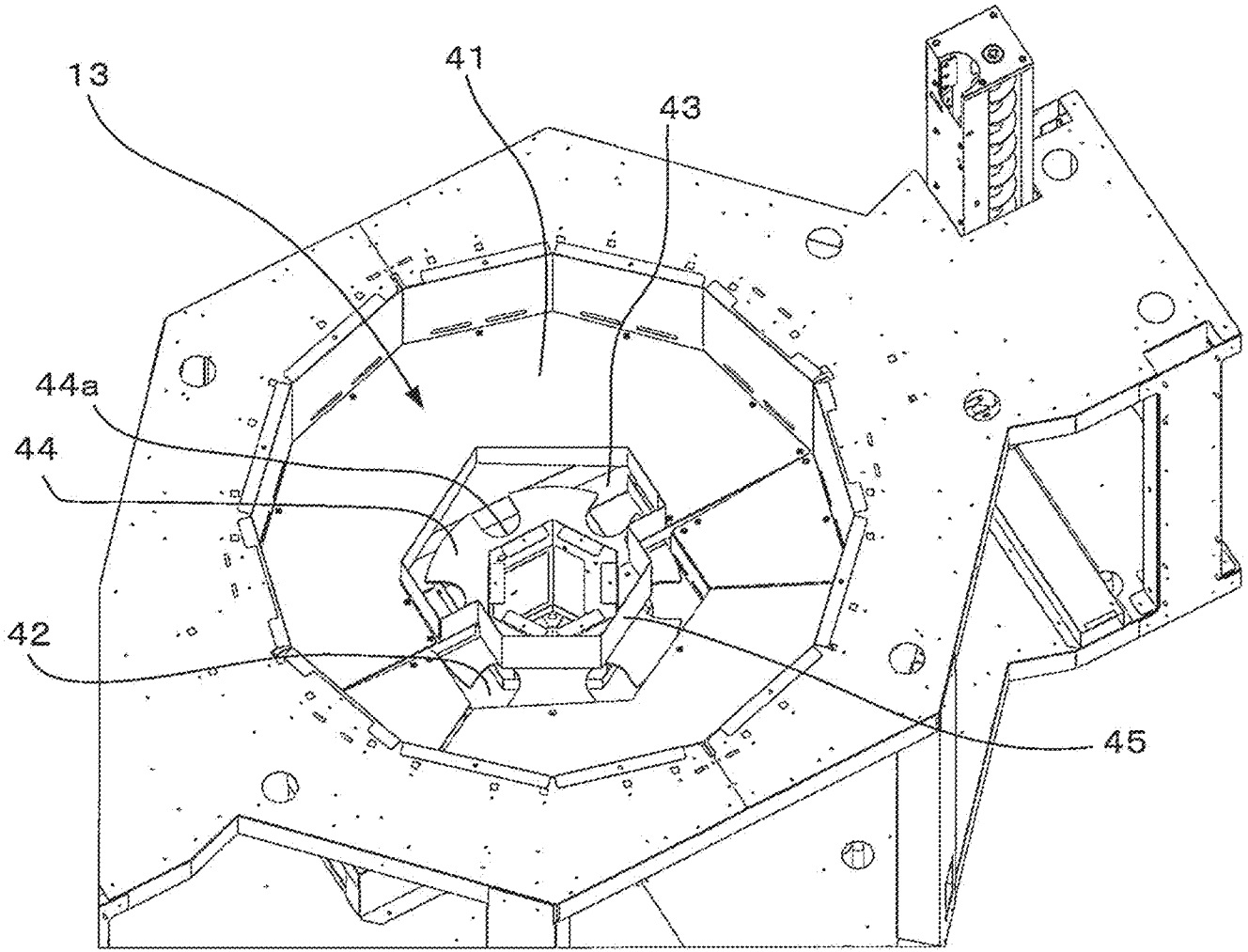
FIG. 5 is a perspective view of a retrieval mechanism.

For each pocket 22, a ball detection sensor 32 is provided for detecting the ball B entered the pocket 22. Various kinds of sensors, as one example, a contact sensor, a photoelectric sensor, or the like, can be employed as the ball detection sensor 32. The guiding passage 24 of the second lottery portion 25 has a width which allows the ball B to move. With respect to the guiding passage 24, a sensor (not illustrated) for detecting the ball B entering the guiding passage 24 is provided to a portion of an inlet side thereof and a stopper member (not illustrated) for restricting advance of the ball B to the rotational field 26 is provided to a portion of an outlet side thereof. In a case where the sensor detects the ball B entering the guiding passage 24, a user is notified of the detection through a display and a sound to call an attention of the user to the guiding passage 24. After a predetermined time passes from that, the stopper member is lowered to allow the ball B to advance to the rotational field 26. When the ball B has entered any one of the pockets 22, the ball B is retrieved by the retrieval mechanism 13. FIG. 5 is a perspective view of the retrieval mechanism 13. The retrieval mechanism 13 is located below the supporting mechanism 28. In FIG. 5, omitted are the members (the first lottery portion 23, the second lottery portion 25, the supporting mechanism 28, the rotational field 26, the drive force 30, and the like) which are rotated by the drive source 29 of the lottery mechanism 11 shown in FIGS. 3 and 4. The retrieval mechanism 13 is provided with a drop face 41 where each of the balls B passed through each pocket 22 drops; a collection portion 42 where the balls B which have dropped on the drop face 41 are collected; a supply passage 43 which supplies the balls B to the discharging mechanism 12; and a move member 44 which makes the balls B move one by one from the collection portion 42 to the supply passage 43. The drop face 41 is provided inclinedly so that the balls B can move to the collection portion 42. Further, a partition 45 is provided so as to prevent the balls B from entering somewhere other than the collection portion 42. The move member 44 is fixed to a drive shaft, and by accepting a drive power of the drive source 29, rotates integrally with the first lottery portion 23 and second lottery portion 25. The move member 44 is a plate-like member, and is provided with a plurality of pockets 44*a* for housing the balls B at equal intervals. Each of the balls B is housed in each pocket 44*a* one-by-one, and by the rotation of the move member 44, moves to the supply passage 43 sequentially. Thereby, it is possible to retrieve the balls B without a jam of the balls B.

Figure 6:
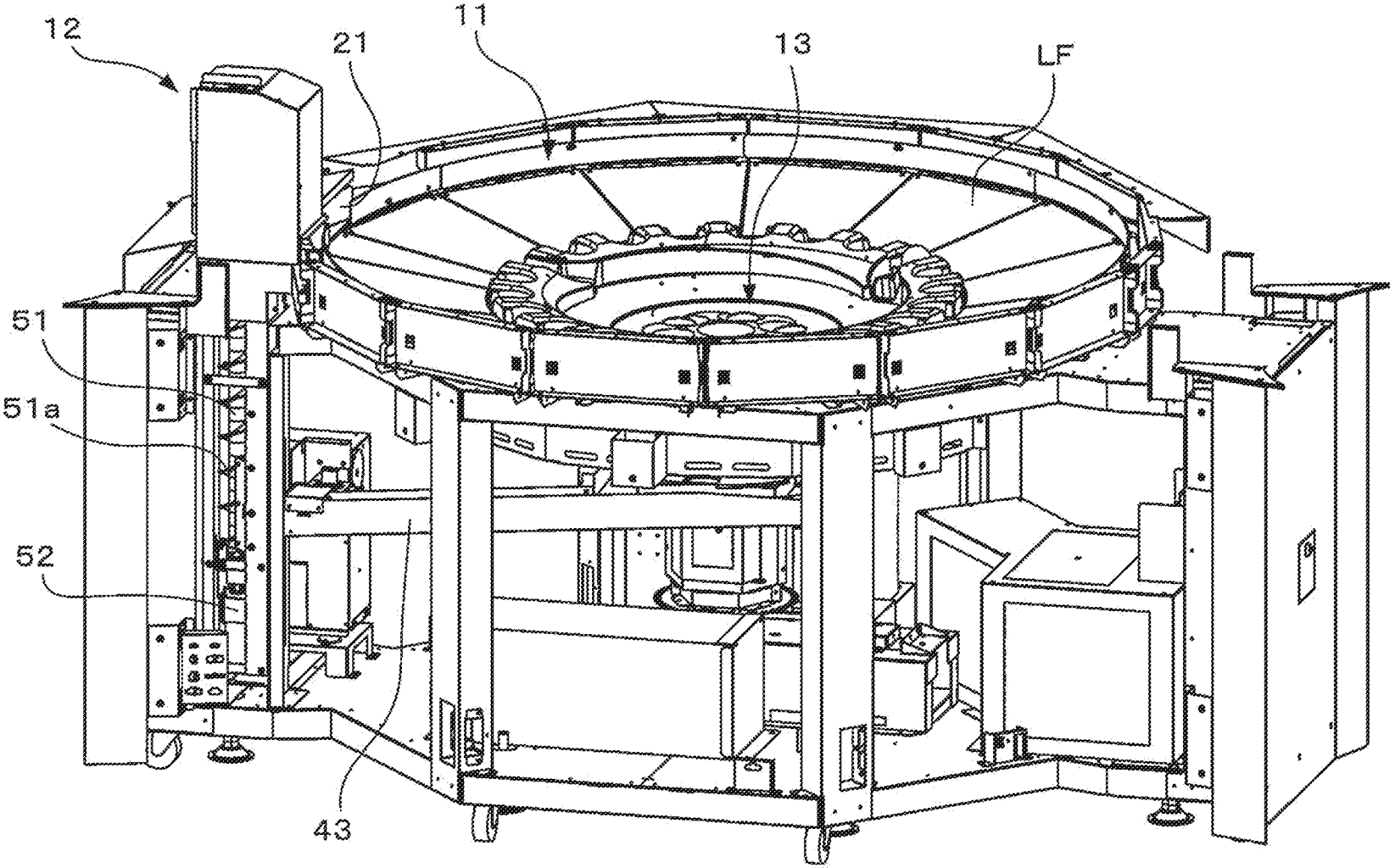
FIG. 6 is a perspective view of a discharging mechanism.

FIG. 6 is a perspective view of the discharging mechanism 12. In FIG. 6, the station units ST are omitted for the purpose of illustration. To the discharging mechanism 12, the supply passage 43 of the retrieval mechanism 13 is connected, and the balls B retrieved from the lottery mechanism 11 are supplied. The discharging mechanism 12 is provided with a conveyance member 51 which conveys the balls B; and a drive source 52 which drives the conveyance member 51. The conveyance member 51 is a stick-like member having a screw 51*a*, and by accepting a drive power of the drive source 52, rotates around an axial line. The balls B are supplied to the screw 51*a* from the supply passage 43. The screw 51*a* rotates and thereby the balls B move upward. After moving, the balls B are discharged to the lottery field LF from the ball slot 21.

Returning to FIG. 2, the station units ST will be explained. Each of the station units ST is provided with a medal slot 61 where medals are input; a monitor 62; a transparent touch panel 63 overlapped on the monitor 62; a card reader 65 which reads a card 64 possessed by a user; and a medal outlet 66 where medals are paid out. When the user input medals to the medal slot 61, the medals are counted as credits. At the station unit ST, games are served in a range depending on consumption of the credits. At the station unit ST, plural kinds of games are served, and the user can select at least one game which he/she wants to play. As one example, served are mini games such as a bingo game, a block erasing game, and a digital pusher game. Each game proceeds depending on the lottery result of the center unit CN. Operations for the games are inputted through the touch panel 63. As the monitor 62, as one example, a liquid crystal display device is employed. The monitor 62 and the touch panel 63 may be configured by using well-known technologies. The card 64 is provided with a non-volatility memory medium (not illustrated), such as an IC chip and a magnetic stripe. In the memory medium, recorded are user identification information which is uniquely set for each card 64 (hereinafter, sometimes referred to as the card ID) and the like. The card ID is used for identifying the user of the game machine 1.

A lottery game served at the game machine 1 will be explained. Based on the lottery result of the lottery executed at the center unit CN, the mini game progresses at each station unit ST. The lottery executed at the center unit CN is executed in such a manner that at least one ball B is discharged to the lottery field LF, and selected is one choice corresponding to the pocket 22 which the ball B has entered. In the lottery at the center unit CN, a predetermined number of balls B are set as a lottery unit, and the lottery executed by the lottery unit is repeated as long as a predetermined end condition is not established. As one example, three balls B are discharged to the lottery field LF for each lottery of the lottery unit. One time of the lottery game starts at the moment of starting the lottery, and ends at the moment of ending the lottery after the end condition is established. When the lottery game ends, a dividend is given to each user depending on the game result of his/her mini game, and the next lottery game is executed.

Figure 7:
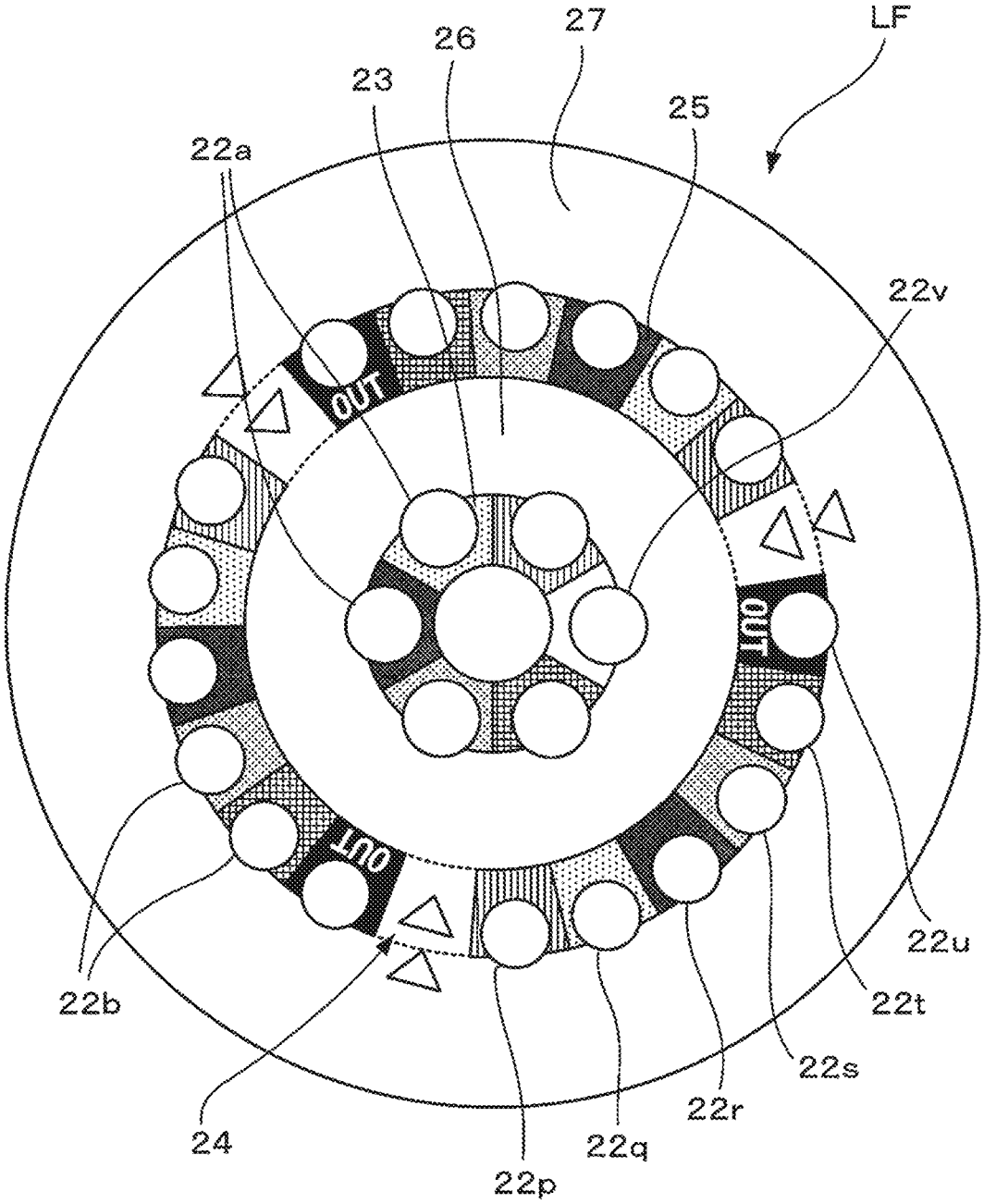
FIG. 7 is a schematic view of a lottery field.

FIG. 7 is a schematic view of the lottery field LF. The plurality of pockets 22 provided on the lottery field LF are composed of colored pockets 22*p* to 22*t* having five colors; at least one end pocket 22*u* for ending the lottery; and at least one ineffective pocket 22*v* for making the establishment of the end condition ineffective. The colored pockets 22*p* to 22*t* include red pockets 22*p*, yellow pockets 22*q*, green pockets 22*r*, light blue pockets 22*s*, and blue pockets 22*t*. Each kind correlated to each of the pockets 22*p* to 22*v* corresponds to each choice of a plurality of choices. In the present embodiment, in the lottery field LF, four colored pockets 22*p* to 22*t* for each color, three end pockets 22*u*, and a single ineffective pocket 22*v* are provided. In the first lottery portion 23, one colored pocket 22*p* to 22*t* for each color and the single ineffective pocket 22*v* are arranged. In the second lottery portion 25, three colored pockets 22*p* to 22*t* for each color and three end pockets 22*u* are arranged in such a manner that the pockets 22*p* to 22*u* are divided into three groups by three guiding passages 24 so that each kind of pocket is included in each group, and also the pockets 22*p* to 22*u* surround the first lottery portion 23 in a circumferential direction.

When the lottery game is started, the lottery game proceeds by the lottery unit. Three balls B are discharged to the lottery field LF from the discharging mechanism 12 in each lottery unit, and each of the balls B enters any one of the pockets 22. For example, if a ball B enters any one of the colored pockets 22*p* to 22*t*, the number of times that the ball B has entered is counted for each color, and the counted number of times impinges on the mini game of the station unit ST. If a ball B enters one of the end pockets 22*u*, the lottery game ends. As the end condition, it is set that a ball B enters the end pocket 22*u*. After entering the pockets 22, the balls B drop on the drop face 41, and are led to the supply passage 43 by the move member 44, and then supplied to the discharging mechanism 12.

If a ball B enters the ineffective pocket 22*v*, the lottery game goes into a "special chance" state, and the end condition becomes ineffective, that is, even if a ball B enters the end pocket 22*u* in the "special chance", the lottery game is continued. In the "special chance" state, if a ball B enters the end pocket 22*u*, the lottery game is continued only one time. In the "special chance" state, if the ball B enters the ineffective pocket 22*v* again, the dividend of the mini game of the station unit ST is doubled. The "special chance" would be set by the lottery unit. For example, after the lottery unit where a ball B entered the ineffective pocket 22*v*, the next lottery unit is set to be in the "special chance" state. The number of times that the lottery unit is allowed to be set to be in the "special chance" state, may be changed as appropriate. Further, in a case where the "special chance" has been established, or in a case where the ball B has entered again the ineffective pocket 22*v* in the "special chance" state, the discharging timing to discharge the balls B with respect to the next lottery unit becomes able to be determined by operations of a user of any one of the station units ST. Which one of the station units ST obtains a decision right of the discharging timing is determined by lottery process, and the user of the selected station unit ST is notified by a display or/and a sound. In the "special chance" state, since the function of the end pockets 22*u* has become ineffective, a user can discharge balls B without hesitation. Further, in a case where a ball B enters a certain pocket 22 which is worth for the other user, the other user might appreciate the user who discharged the ball B. Thereby, it is also possible to promote making the user feel uplifted. On the other hand, in a case where no operation for specifying the discharging timing is performed within a predetermined time at the station unit ST which has obtained the decision right of the drawing timing, the balls B are discharged automatically. The game settings with respect to the lottery game, such as the number of or the kinds of colored pockets, the number of end pockets 22*u* or ineffective pockets 22*v*, the location of each pocket 22, the end condition, and the setting of the "special chance", may be changed as appropriate.

On the other hand, at the station unit ST, plural kinds of mini games are served. A user selects one mini game or more, bets credits, and receives the dividend depending on the lottery result of the center unit CN. At the game machine 1, the user is allowed to play plural mini games in parallel. At the monitor 62, a game screen of the mini games can be displayed. In the game screen, each of the mini games selected by a user may be displayed on each of the divided game screens, or is displayed switchably to each other.

Figure 8:
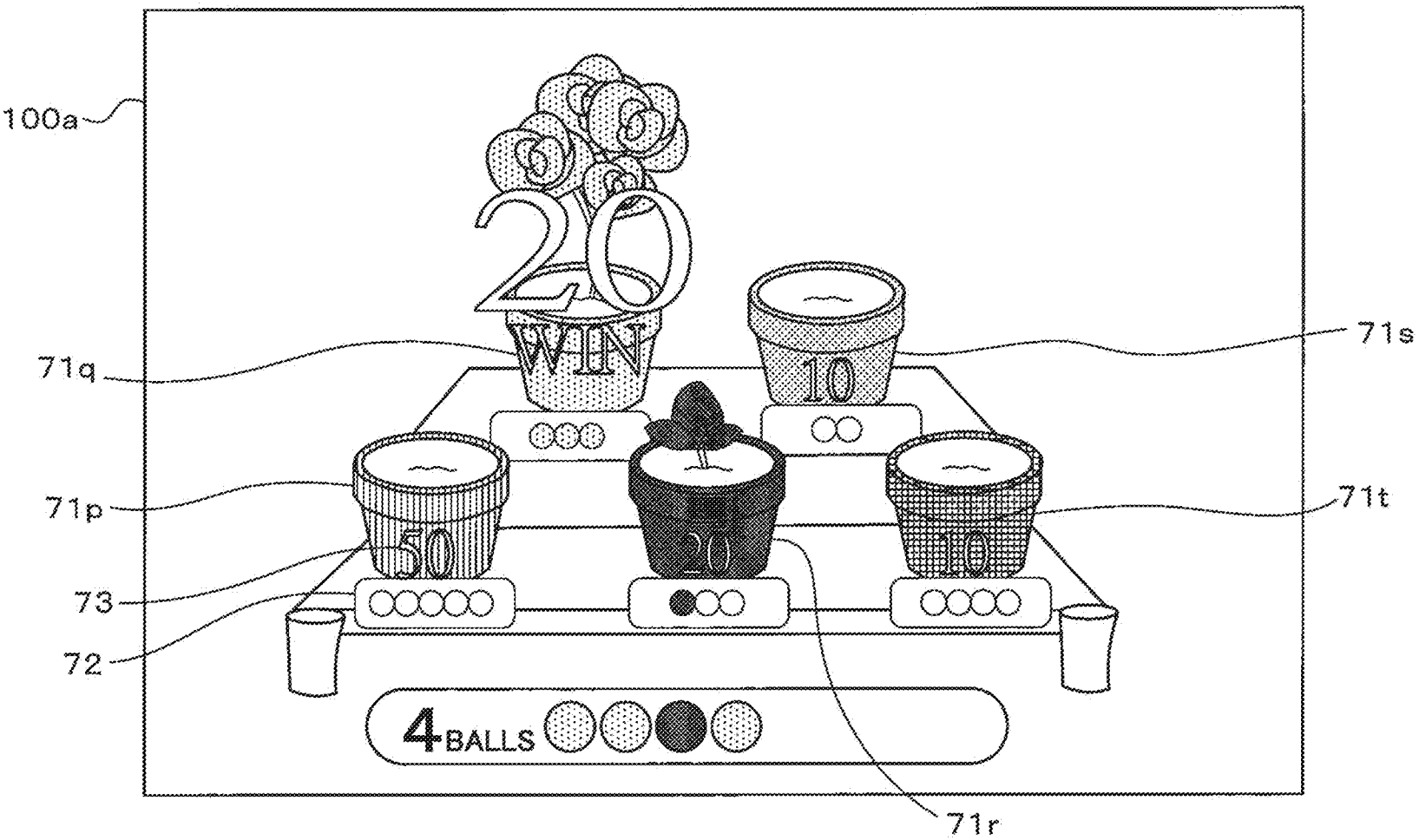
FIG. 8 is a diagram showing one example of a game screen of a basic game.

As one example of the mini game, a basic game, where the number of selections is incremented for each selected color as the number of pieces of the selected color, and a dividend is given to a user depending on the number of pieces of each selected color, will be described. FIG. 8 is a diagram showing one example of a game screen 100*a* of the basic game. In the basic game, a user bets credits on each his/her expecting color. For each color, predetermined odds are set, and in accordance with increase of the number of pieces incremented, the dividend also increases. As one example, each color is represented as each of the pot plants 71*p* to 71*t*, and when the number of pieces of a certain color reaches a target number, flowers bloom at the pot plant 71*a* corresponding to the color and the dividend is given. At the pot plant 71*p* to 71*t* of each color, displayed are a target number of pieces 72 at which the dividend is given, and the dividend 73 corresponding to the target number of pieces 72. In the game screen 100*a* shown in FIG. 8, since 3 yellows have been selected at the lottery mechanism 11 and thereby the number of pieces incremented has reached the target number 72, it is displayed that flowers bloom at the pot plant corresponding to yellow and the dividend obtained is also displayed. The target numbers 72 may be changed as appropriate. Further, when the number of pieces incremented for a certain color has reached the target number 72 displayed in the game screen 100*a*, the next target number 72 may be displayed.

Figure 9:
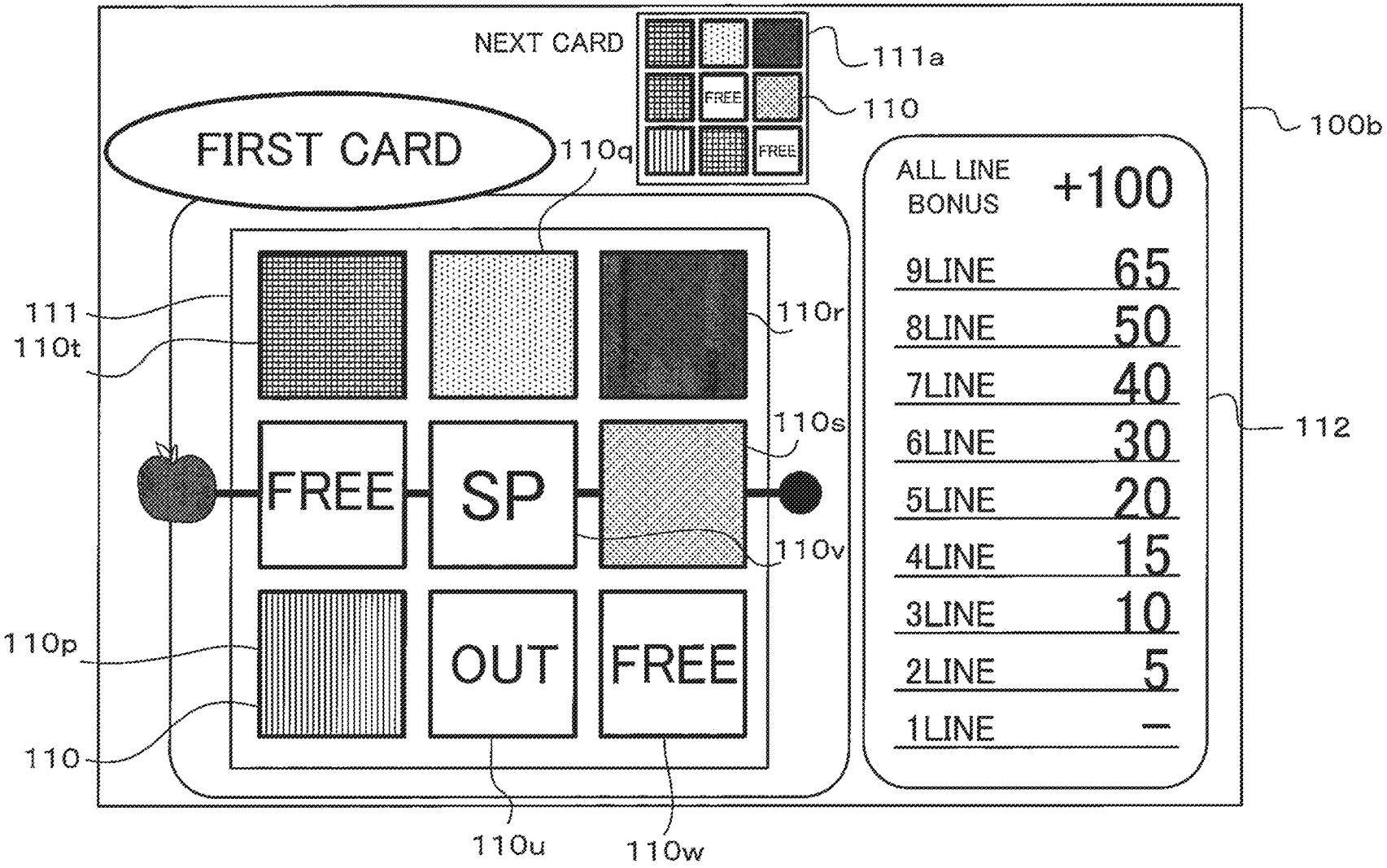
FIG. 9 is a diagram showing one example of a game screen of a bingo game.

Further, at the station unit ST, as one example of the other mini game, a bingo game is served. FIG. 9 is a diagram showing one example of a game screen 100*b* of the bingo game. In the bingo game, the game progresses by using a bingo card 111 having 3 rows by 3 columns squares, each square 110 corresponding to a choice selected at the lottery mechanism 11. In the game screen 100*b*, the bingo card 111, the next bingo card 111*a*, and an odds list 112 are displayed. The squares 110 includes squares 110*p* to 110*t* correlated to the colored pockets 22*p* to 22*t* respectively, a square 110*u* correlated to the end pocket 22*u*, a square 110*v* correlated to the ineffective pocket 22*v*, and a free square 110*w* which is set to be effective from first. 9 squares are selected at random from those squares 110*p* to 110*w*, and disposed on the bingo card 111. A square 110 corresponding to a pocket 22 which a ball B has entered at the lottery mechanism 11 becomes effective, and when three squares aligning in any one of the row, column, and diagonal directions has become effective, bingo is established by the three squares.

If at least one bingo is established, the bingo card 111 being used at the present is finished up and the next bingo card 111*a* is delivered. And then, the bingo game progresses in the same way. Until the lottery game ends, the bingo game continues. At the end of the lottery game, the dividend is given to a user depending on the number of bingos established. One bingo card 111 corresponds to one stage. When the bingo card is changed to the next bingo card 111*a*, the stage is also changed to a new stage. If all lines in one bingo card 111 become effective at the same time, an all-line bonus is given to the user. At the lottery mechanism 11, there is a possibility that a ball B enters the pockets 22 having a same kind, for example a same color, plural times. In this case, the next bingo card 111*a* may be changed so that a square 110 of the next bingo card 111*a* becomes advantageous to the game progress. For example, any one of the squares 110 of the next bingo card 111*a* may be changed to a colored square 110, the color of which was selected at the lottery mechanism 11. If the number of same kind squares increases, the bingo becomes easily established. So, it is possible to raise user's expectation to the dividend. Further, on a condition that a ball B enters pockets 22 correlated to a particular color, the next bingo card 111*a* may be changed so that a square 110 of the next bingo card 111*a* becomes advantageous to the game progress. In this case, if what color of the pocket 22 a ball B should enter is displayed, even if the color is not used in the present bingo card 111, it is possible to raise user's expectation that a ball B enters the color of pocket 22.

As the mini game progressing depending on the lottery result of the lottery mechanism 11, a game other than the mentioned two games may be served. For example, a block erasing game that in a game region covered by blocks, each block corresponding to each choice of the lottery mechanism 11, a block corresponding to a color selected is erased, and new blocks are added to compensate the erased blocks; a digital pusher game that a predetermined number of medals are supplied to a pusher field depending on a color selected; or the like may be served. Rules of each game may be set as appropriate. Further, a well-known game may be employed as the mini game.

Figure 10:
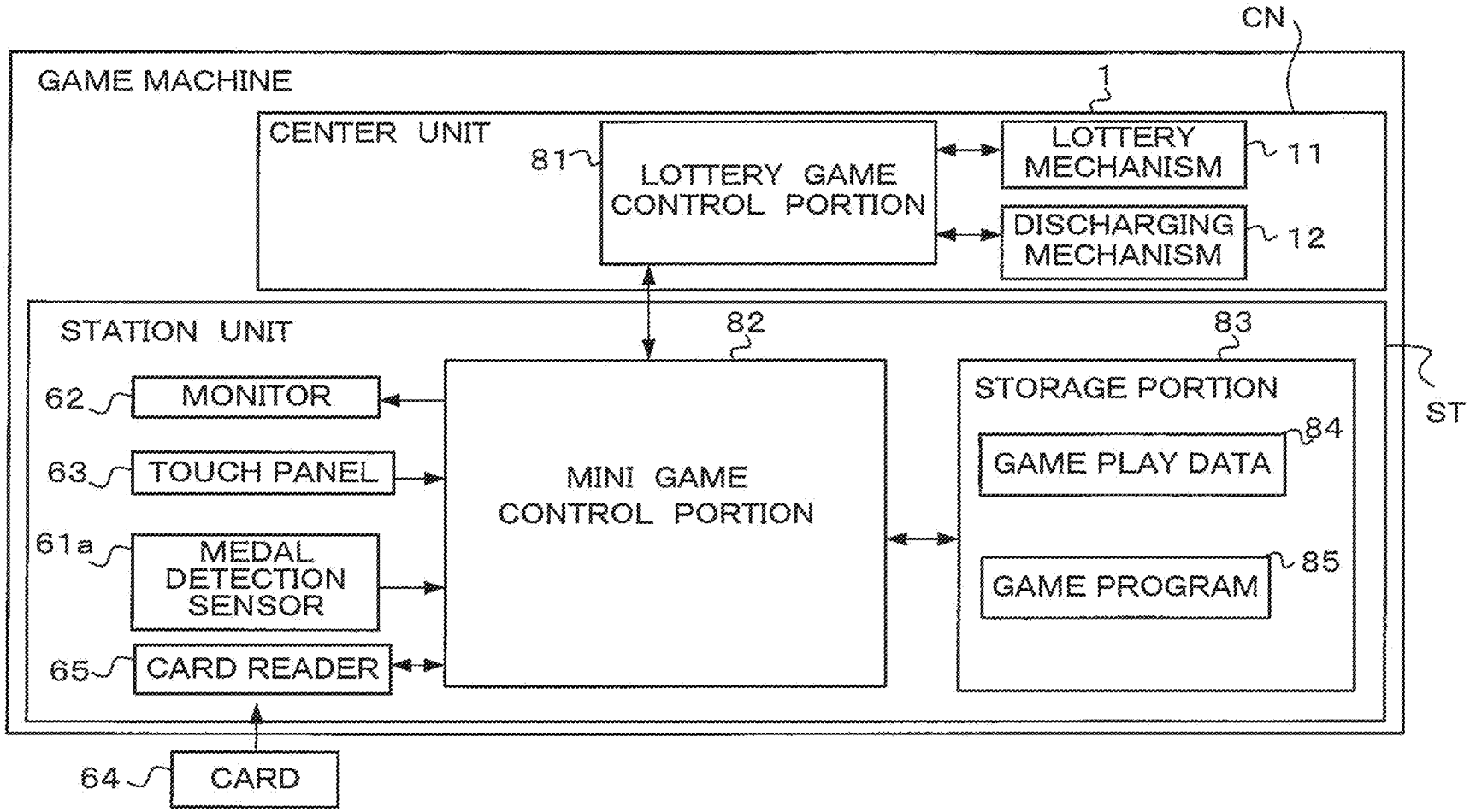
FIG. 10 is a functional block diagram for explaining a configuration of main parts of a control system of the game machine.

FIG. 10 is a functional block diagram for explaining a configuration of main parts of a control system of the game machine 1. The center unit CN of the game machine 1 is provided with a lottery game control portion 81 which controls the lottery game by controlling the lottery mechanism 11 and the discharging mechanism 12. Each station unit ST is provided with a mini game control portion 82 for controlling the mini games and a storage portion 83. Although the game machine 1 has a plurality of station units ST, only one station unit ST is displayed in FIG. 10. Each of the game control portions 81 and 82 is a logical device which is realized by a combination of computer hardware and software of the game machine 1. The lottery game control portion 81 and the mini game control portion 82 are connected with each other, and communicated with each other about game results and the like obtained on each of the units CN and ST.

The mini game control portion 82 obtains a lottery result of the lottery game controlled by the lottery game control portion 81 and controls progress of each mini game. In addition, to the mini game control portion 82, a monitor 62 provided to the station unit ST, a touch panel 63, a medal detection sensor 61*a* which is mounted at the medal slit to detect medals, and a card reader 65. The card reader 65 reads out information from the card 64 where the user identification information is recorded, and outputs a signal corresponding to the read information to the mini game control portion 82. The storage portion 83 is an external storage device realized as a storage unit such as a hard disk array device. In the storage portion 83, game play data 84 and a game program 85 for executing the mini games are stored as well as various kinds of data necessary for controlling the mini games and serving various kinds of services.

Figure 11:
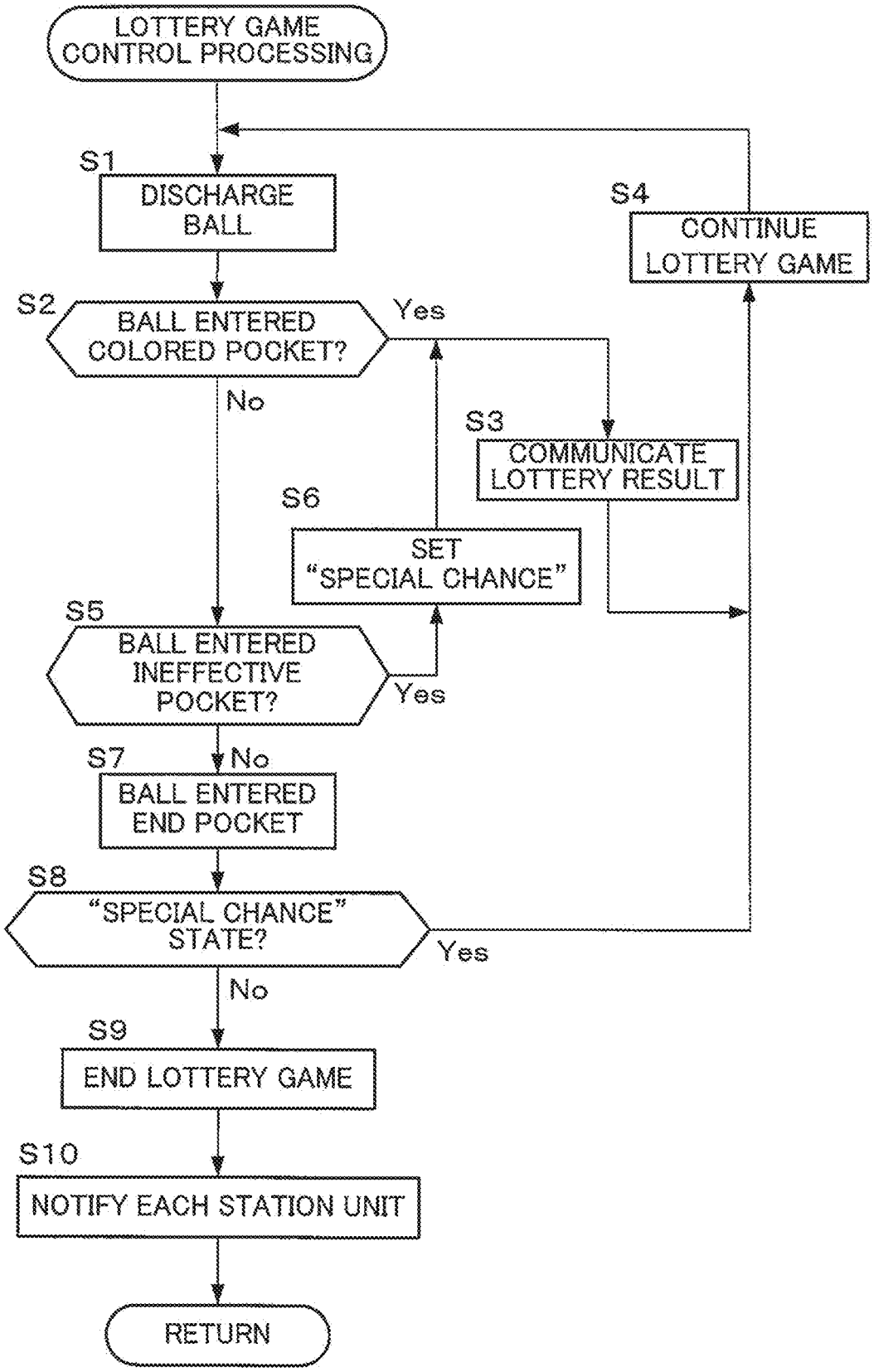
FIG. 11 is a flowchart showing lottery game control processing which is executed by a lottery game control portion of the center unit.

FIG. 11 is a flowchart showing lottery game control processing which is executed by the lottery game control portion 81 of the center unit CN. At the center unit CN, the lottery game is executed. When receiving a lottery game starting request from the station unit ST, the lottery game control portion 81 starts the lottery game. The lottery game control portion 81 discharges the balls B of the lottery unit to the lottery field LF (step S1). As one example, three balls B are discharged. The lottery game control portion 81 determines whether the ball B discharged has entered the colored pockets 22*p* to 22*t* (step S2). In a case where the ball B has entered any one of the colored pockets 22*p* to 22*t*, the lottery game control portion 81 communicates the color of the pocket 22 the ball B has entered to each station unit ST (step S3), and continues the lottery game (step S4). The lottery game control portion 81 returns to step S1.

In a case where the ball B has not entered the colored pockets 22*p* to 22*t*, the lottery game control portion 81 determines whether the balls B has entered the ineffective pocket 22*v* (step S5). In a case where the ball B has entered the ineffective pocket 22*v*, the lottery game control portion 81 sets the "special chance" (step S6). For example, at the center unit CN, the establishment of the "special chance" is presented. The lottery game control portion 81 notifies each station unit ST of the fact that the ball B has entered the ineffective pocket 22*v* (step S3), and continues the lottery game (step S4). In a case where the ball B has not entered the ineffective pocket 22*v*, the lottery game control portion 81 detects that the ball B has entered the end pocket 22*u* (step S7). The lottery game control portion 81 determines whether the present time is in the "special chance" state (step S8). In a case where not in the "special chance" state, the lottery game control portion 81 ends the lottery game (step S9). And then, the lottery game control portion 81 notifies each station unit ST of a fact that the lottery game has ended (step S10) to end the processing of this turn. In a case where the present time is in the "special chance" state, the lottery game control portion 81 continues the lottery game (step S4).

According to the above mentioned processing, in the lottery game, balls B are discharged to the lottery field LF for each lottery unit (step S1). In a case where a ball B enters any one of the colored pockets 22*p* to 22*t* (step S2), the lottery result is communicated to each station unit ST (step S3), and the lottery game is continued (step S4). In a case where a ball B enters the ineffective pocket 22*v* (step S5), the "special chance" state is set (step S6), the lottery result is communicated to each station unit ST (step S3), and the lottery game is continued (step S4). In a case where a ball B enters the end pocket 22*u* (step S7), in the "special chance" state, the end of the lottery game becomes ineffective and the lottery game is continued (step S4). On the other hand, in not the "special chance" state, the lottery game is ended (step S9), and the result is communicated to each station unit ST (step S10)

In the above mentioned processing, the lottery game control portion 81 executing the processes of steps S1 to S10 functions as a discharging control device. Especially, the lottery game control portion 81 executing the processes of steps S2 to S9 functions as a continuous discharging control device. As the end condition, it is set that a ball B enters the end pocket 22*u*, that is, that a ball B is detected by the ball detection sensor 32 of the end pocket 22*u*. The lottery game ends except for a case where the moment is not in the "special chance" state.

Figure 12:
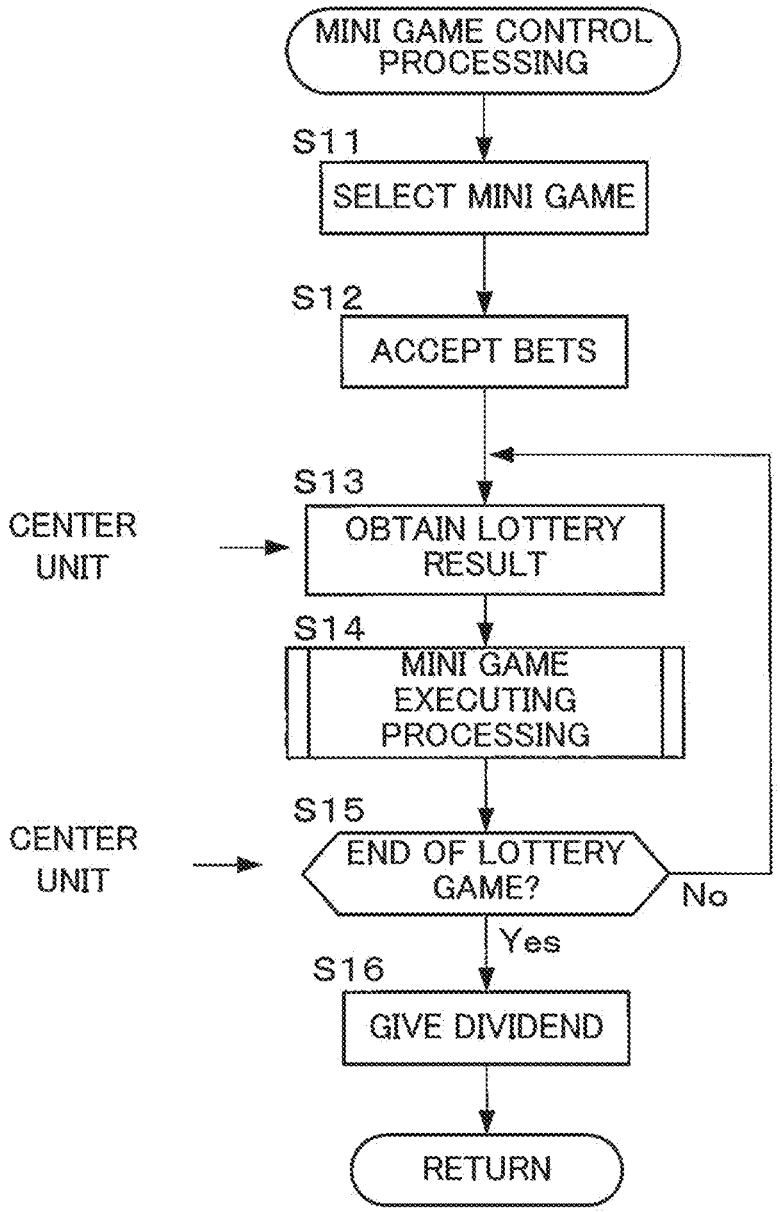
FIG. 12 is a flowchart showing a mini game control processing executed by a mini game control portion of the station unit.

FIG. 12 is a flowchart showing a mini game control processing executed by the mini game control portion 82 of the station unit ST. At the station unit ST, the mini game is executed. The mini game control portion 82 allows a user to select one mini game or more which the user is going to play in the lottery game of this turn (step S11), and displays the mini game(s) selected by the user in the game screen 100. All mini games served by the station unit ST can be selected, or the number of mini games the user can select may be restricted. When displaying the mini game(s) in the game screen 100, the mini game control portion 82 may produce the bingo cards 111 and 111*a*. Subsequently, the mini game control portion 82 accepts bets of the user (step S12). A bet accepting period for accepting bets is set at the same timing through the station units ST. When the bet accepting period ends, the lottery game is executed at the center unit CN.

Subsequently, the mini game control portion 82 obtains a lottery result from the center unit CN (step S13), and executes executing processing for the mini game(s) selected by the user (step S14). The detail of this mini game executing processing will be explained later. And then, the mini game control portion 82 determines whether the lottery game of the center unit CN has ended (step S15). In a case where the lottery game has not yet ended, the mini game control portion 82 returns to step S13 to obtain a lottery result from the center unit CN and continue the mini game. On the other hand, in a case where the lottery game has ended, based on the result of the mini game(s) selected for this turn by the user, the dividend is given to the user (step S16), and the processing of this turn is ended.

According to the above mentioned processing, at the station unit ST, the mini game(s) to be played is (are) selected by the user (step S11), and bets are accepted in a predetermined period (step S12). When the bet accepting period is expired, the lottery game is started at the center unit CN and each station unit ST obtains the lottery game (step S13). Based on the lottery result, the mini game is executed (step S14), the mini game continues until the lottery game ends (step S15). When the lottery game ends, the dividend is given to the user appropriately for the result of the mini game(s) (step S16).

In the above mentioned processing, the mini game control portion 82 executing the processes of steps S13 to S15 functions as a game executing device. The mini game control device 82 executing the process of step S16 functions as a dividend giving device.

Figure 13:
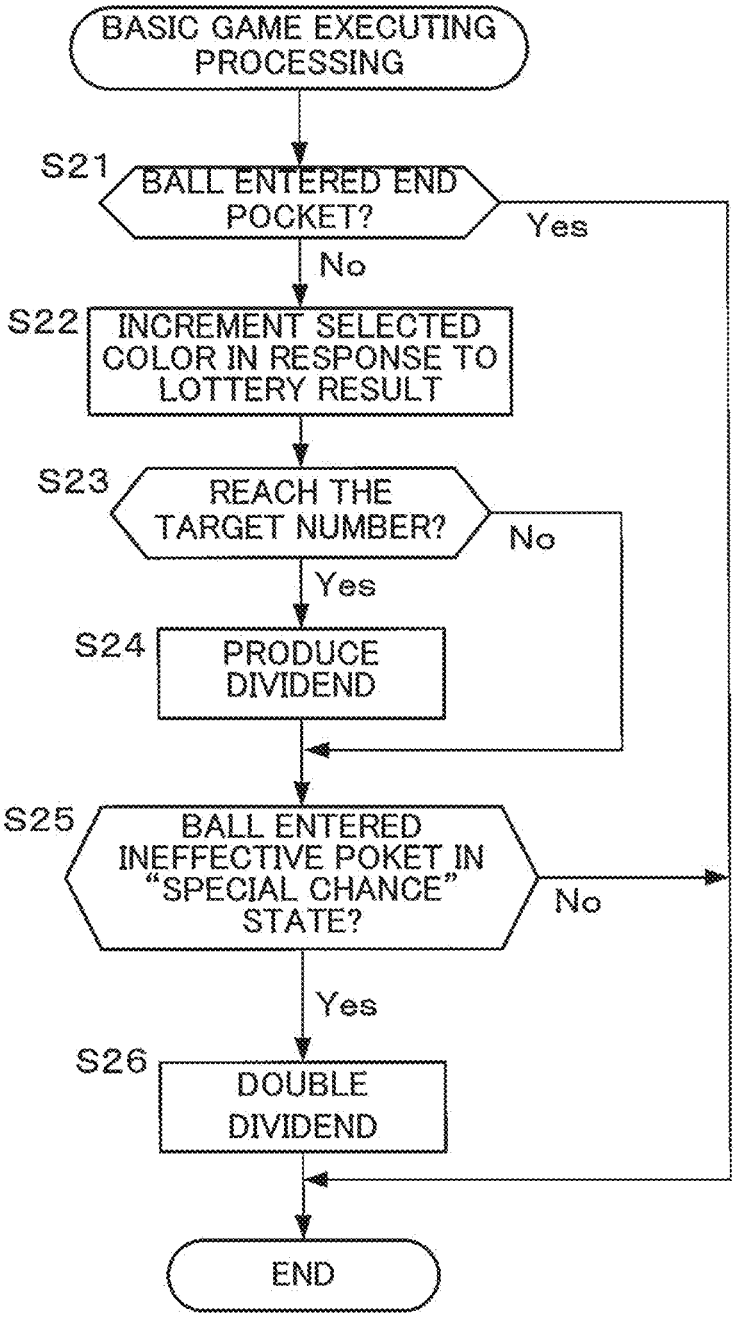
FIG. 13 is a flowchart showing a basic game executing processing executed by the mini game control portion.

As one example of the mini game executing processing which is executed at step S14 of FIG. 12, a case of the basic game will be explained. FIG. 13 is a flowchart showing a basic game executing processing executed by the mini game control portion 82. When obtaining the lottery result from the center unit CN (step S13 of FIG. 12), the mini game control portion 82 determines whether the ball B has entered the end pocket 22*u* (step S21). In a case where the ball B has entered the end pocket 22*u*, the mini game control portion 82 goes to step S15 of FIG. 12. On the other hand, in a case where the ball B has not entered the end pocket 22*u*, the mini game control portion 82 increments the number of pieces of color for each selected color in response to the lottery result (step S22). And, the mini game control portion 82 determines whether the number of pieces incremented has reached the target number of pieces 72 set for each color (step S23). In a case where the number of pieces incremented has reached the target number 72, the mini game control portion 82 produces the dividend to be given to the user (step S24). Further, the mini game control portion 82 determines whether the ball B has entered the ineffective pocket 22*v* in the "special chance" state (step S25). In a case where the ball B has, the mini game control portion 82 doubles the dividend to be given at step S16 of FIG. 12 (step S26), and goes to step S15 of FIG. 12. In FIG. 12, until the lottery game ends, the processes of steps S13 to S15 are repeated, and the basic game executing process is executed in each time.

Figure 14:
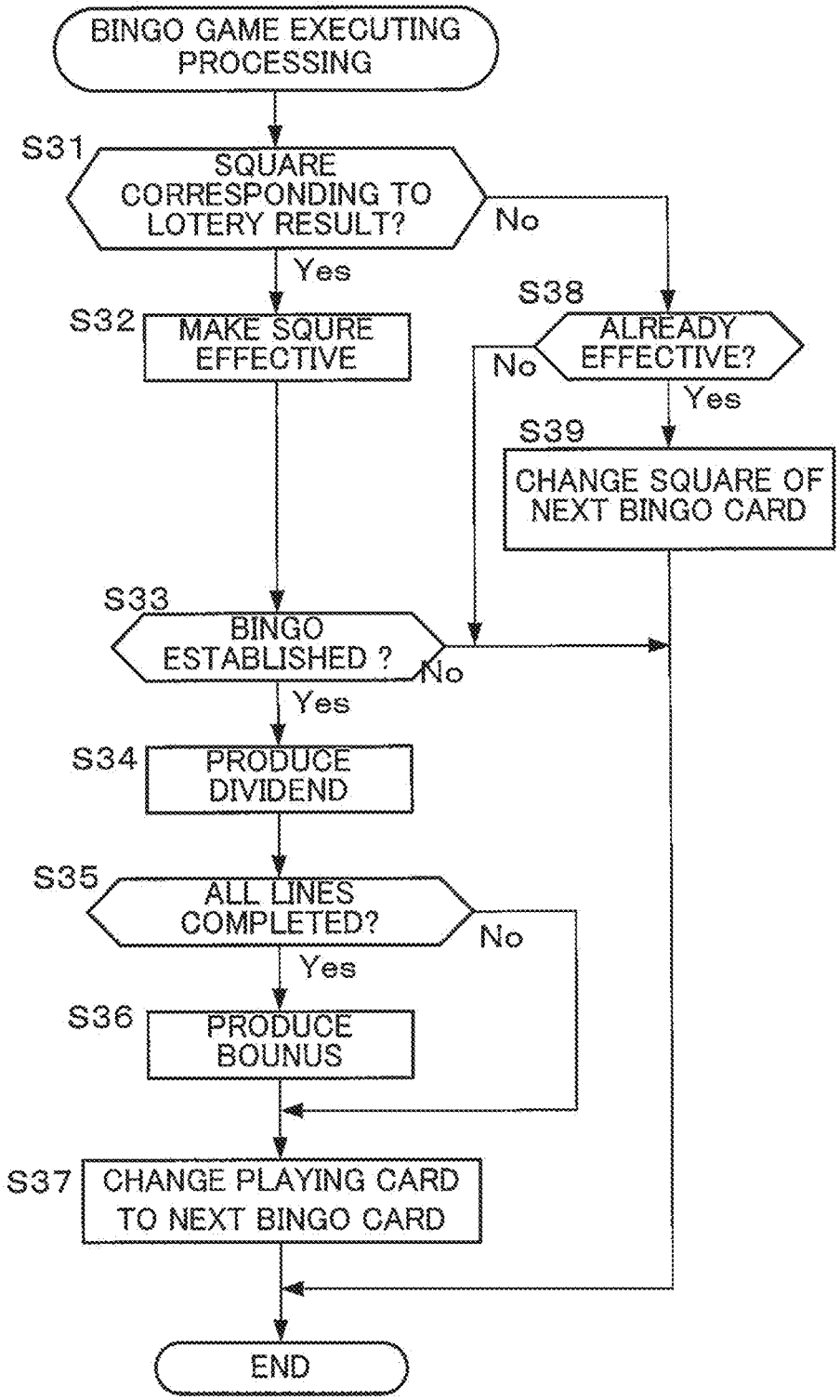
FIG. 14 is a flowchart showing a bingo game executing processing executed by the mini game control portion.

As the other example of the mini game executing process which is executed at step S14 of FIG. 12, a case of the bingo game will be explained. FIG. 14 is a flowchart showing a bingo game executing process executed by the mini game control portion 82. When obtaining the lottery result from the center unit CN (step S13 of FIG. 12), the mini game control portion 82 determines whether the bingo card 111 has a square 110 corresponding to the lottery result (step S31). In a case where the bingo card 111 has, the mini game control portion 82 makes the square 110 effective (step S32), and determines whether the bingo has been established (step S33). In a case where the bingo has, the mini game control portion 82 produces the dividend (step S34). The dividend is produced according to the odds list 112. With respect to the bingo established first, it is not necessary to produce the dividend. The setting may be changed as appropriate depending on a difficulty level of the game. Further, the mini game control portion 82 determines whether all squares 110 have become effective (step S35). When all squares 110 have become effective, the mini game control portion 82 produces the all-line bonus (step S36). And then, the mini game control portion 82 changes a card to be used to the next bingo card 111*a* (step S37), and goes to step S15 of FIG. 12.

On the other hand, in a case where the bingo card 111 does not have a square 110 corresponding to the lottery result at step S31, the mini game control portion 82 determines whether the square 110 corresponding to the lottery result has become already effective (step S38). In a case where the square 110 was the choice already selected in the lottery game, the mini game control portion 82 changes a square 110 of the next bingo card 111*a* (step S39). The mini game control portion 82 may determine a predetermine color and, each time when a choice which was already selected is selected again, may increase a square 110 corresponding to the choice on the next bingo card 111*a*, or may change a square 110 of the next bingo card 111*a* to a square 110 corresponding to the selected choice. The square 110 to be changed of the next bingo card 111*a* may be determined at random, or any square 110 on the next bingo card 111*a* may be changed except the free square 110*w*. Appropriate setting is possible. After step S39, the mini game control portion 82 goes to step S15 of FIG. 12. In a case where a negative determination is obtained at step S38, for example, in a case where the choice which the bingo card 111 does not have a square 110 corresponding to, or the end pocket 22*u* has been selected, the mini game control portion 82 also goes to step S15 of FIG. 12.

The present invention is not limited to the above mentioned embodiment, and may be executed in various embodiments. For example, in the above embodiment, the number of balls B to be discharged to the lottery field LF is set to three for each lottery unit. However, the present invention is not limited to this embodiment. A single ball, two balls, or four balls may be applied. Though the number of balls B is fixed to three as the lottery unit during the lottery game, the present invention is not limited to this embodiment. The number of balls B for each lottery unit may be changed as the game progresses. For example, the number of balls B of the first lottery unit may be set to three, and the number of balls B of the second lottery unit may be set to two, and after that, the number of balls B of the lottery unit may be set to one. As the game progresses, the number of balls B may be increased, or decreased. Any appropriate setting can be applied.

In the above embodiment, the choices each being correlated to the pocket 22 in the lottery field LF of the center unit CN are fixed. However, the present invention is not limited to this embodiment. The position of each choice may be changed as the game progresses. Such a change of position may be determined at random, or according to an instruction by a user. Further, with respect to the choices provided to the lottery field LF, the number of choices for each kind may be changed. For example, when a user uses a specific item, the ineffective pockets 22*b* may be increased, or a pocket 22 corresponding to a specific color may be increased. Each time when the lottery of the lottery unit ends, the number of end pockets 22*u* may be increased. In this case, the pocket 22 which the ball B has entered may be changed to the end pocket 22*u* sequentially. The change rate of each pocket 22 may be changed in an ongoing lottery game. Any appropriate change can be applied. In this case, a projector is provided above the center unit CN, the choices may be displayed understandably to users in such a way that each choice is displayed around each corresponding pocket 22 of the first lottery portion 23 and the second lottery portion 25. The pockets 22 may have different colored LEDs therein respectively so as to be displayed in different colors from each other. The number of guiding passages 24 may be changed. For example, the following embodiment may be applied. A movable restriction member is provided so as to close the guiding passages 24, and the number of available guiding passages 24 is controlled based on conditions of the game.

Further, it is not necessary that only one choice is correlated to each pocket 22 in the lottery field LF of the center unit CN. Plural choices can be correlated to one pocket 22. For example, since the first lottery portion 23 has a lower possibility that a ball B enters a pocket 22 than the second lottery portion 25, with respect to at least one part of the pockets 22*a* of the first lottery portion 23, each pocket 22*a* is correlated to at least two colors. In a case where a ball B enters such a pocket 22*a*, with respect to each of the corresponding colors, the number of pieces is incremented. Furthermore, in a case where a predetermined condition is satisfied, the number of choices corresponding to one pocket 22 may be changed dynamically. For example, in the "special chance" state, with respect to at least a part of pockets 22 of the first lottery portion 23 or/and the second lottery portion 25, each pocket 22 may be correlated to at least two colors. Thereby, it is possible to raise user's expectations. In addition, the number of choices correlated to each of the at least one part of the pockets 22 may be different between a state that the total number of discharged balls B is less than a predetermined number is different and a state that the total number of discharged balls B is the predetermined number or more. In a case where a ball B has entered a pocket 22 correlated to two or more choices, an incremented value may be set differently from an incremented value of a case where a ball B has entered a pocket 22 correlated to one choice. For example, in a case where a ball B has entered a pocket 22 correlated to two colors, 0.5 may be incremented with respect to each color.

In the above embodiment, during the "special chance" state, the end condition becomes ineffective. However, the present invention is not limited to this embodiment. For example, the following embodiments may be applied. The "special chance" state is set so as to continue over a predetermined number of lottery units, and the number of end pockets 22*u* is decreased during the "special chance" state. For example, the following embodiment may be applied. In a case where the "special chance" state is set to continue over three lottery units, no end pocket 22*u* is provided in the first lottery unit, a single end pocket 22*u* is provided in the second lottery unit, and two end pockets 22*u* are provided in the third lottery unit. From the next (forth) lottery unit, the game is continued with normal three end pockets 22*u*.

With respect to the basic game, in the above embodiment, when a ball B enters one of the colored pockets 22*p* to 22*t*, the number of pieces corresponding to the selected color is incremented by 1. However, the present invention is not limited to this embodiment. For example, the incremented value may be changed depending on positions of the colored pockets 22*p* to 22*t*. In the lottery field LF, the probability that a ball B enters a pocket 22 of the first lottery portion 23 is less than the probability that a ball B enters a pocket 22 of the second lottery portion 25. In such a case, when a ball B enters any one of the colored pockets 22*p* to 22*t* of the first lottery portion 23, the number of pieces may be incremented by 2 with respect to the selected color. In addition, in the "special chance" state, when a ball B enters any one of the colored pockets, the incremented value may be increased with respect to each selected color. Or, with respect to a case where a ball B has entered a same pocket 22 plural times in one lottery game, the incremented value may be increased from the second time.

In the above mentioned embodiment, the lottery game executed at the center unit CN is executed using the lottery mechanism 11 and the discharging mechanism 12 which are physical ones. However, the preset invention is not limited to this embodiment. For example, a monitor is set to display a game screen, and the lottery game may be provided as an electronic lottery game. In this case, the game bodies may be controlled in a similar way to be discharged to the lottery filed LF. In the above embodiment, a spherical ball B is applied to the game body. However, the present invention is not limited to this embodiment. For example, an oval ball may be applied. Or, a disk-shaped game body may be applied in a condition that the disk-shaped game body is made to slip on a field where friction is reduced between the disk-shaped one and the field. In a case of the electronic lottery game, the game body may be set to any shape, such as a character and various kinds of things, as appropriate.

In the above mentioned embodiment, with respect to the bingo game served by each station unit ST, a range where a user can play with one bingo card 110 is set to a stage. However, the present invention is not limited to this embodiment. The concept of stage of game can be applied to various kinds of games. For example, in a case of the block erasing game where a block corresponding to selected color is erased and the purpose is to erase all blocks, when all blocks are erased, the corresponding stage is ended, and a new stage may be served. To the new stage, a condition advantageous to a user may be given. Any appropriate setting can be applied.

In the above mentioned embodiment, the lottery game continues as long as the end condition is not established. Therefore, the time when one lottery game ends is variable. By using this, as one mini game served by each station unit ST, an estimation game which makes a user estimate the number of discharges of balls B may be served. As an embodiment for making a user estimate the number of discharges, it may be applied to make a user estimate how many times the lottery unit is repeated, or to make a user estimate more detail in consideration of the order of the pockets 22 which balls B enter in each lottery unit. Thereby, even if the lottery game ends with a small number of discharges, the dividend is given to a user who estimated the small number of discharges. Accordingly, it is possible to maintain attractivity of the game.

As explained above, the game machine as one aspect of the present invention is a game machine (for example, the game 1) comprising: a lottery mechanism (for example, the lottery mechanism 11) where a plurality of pockets (for example, the pockets 22*p* to 22*v*), each of the plurality of pockets being correlated to at least one choice out of a plurality of choices, are provided in order to select the at least one choice, and a lottery is executed in such a way that by making a game body (for example, the ball B) enter any one of the plurality of pockets, the at least one choice correlated to the pocket is selected; a discharging mechanism (for example, the discharging mechanism 12) which discharges at least one game body to the lottery mechanism; and a computer (for example, the lottery game control portion 81 shown in FIG. 10), wherein the computer functions by executing a computer program, as a discharging control device (for example, the lottery game control portion 81 shown in FIG. 10) which is configured to control the discharging mechanism so that at least one game body is discharged to the lottery mechanism as one lottery unit, and have a continuous discharging control device (for example, the lottery game control portion 81 shown in FIG. 10) which is configured to control the discharging mechanism so that the at least one game body is discharged continuously to repeat the lottery by the lottery unit, as long as a predetermined end condition is not established.

The game control method as another aspect of the present invention is a game control method for making a computer (for example, the lottery game control portion 81 shown in FIG. 10) of a game machine function, the game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; and a discharging mechanism which discharges at least one game body to the lottery mechanism, wherein the game control method making the computer execute a discharging control step (for example, steps S1 to S10 shown in FIG. 11) of controlling the discharging mechanism so that at least one game body is discharged to the lottery mechanism as one lottery unit, and in the discharging control step, further execute a continuous discharging control step (for example, steps 2 to S9 shown in FIG. 11) of controlling the discharging mechanism so that the at least one game body is discharged continuously to repeat the lottery by the lottery unit, as long as a predetermined end condition is not established.

The non-transitory computer readable storage medium as another aspect of the present invention is a non-transitory computer readable storage medium storing a computer program for making a computer of a game machine function, the game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; and a discharging mechanism which discharges at least one game body to the lottery mechanism, wherein the computer program makes the computer function as a discharging control device which is configured to control the discharging mechanism so that at least one game body is discharged to the lottery mechanism as one lottery unit, and further makes the computer as the discharging control device function as a continuous discharging control device which is configured to control the discharging mechanism so that the at least one game body is discharged continuously to repeat the lottery by the lottery unit, as long as a predetermined end condition is not established.

If the computer program according to the present invention is installed to, for example, a computer and executed by using this storage medium, it is possible to realize a game system according to the present invention by using the computer. The storage medium storing the computer program is a non-transitory one such as a CD-ROM.

As one embodiment of the game machine of the present invention, the continuous discharging control device may be configured to end the lottery of a next lottery unit in a case where the predetermined end condition is established. Further, as one embodiment of the present invention, the discharging control device may be configured to control to make the discharging mechanism discharge to the lottery mechanism, a plurality of game bodies set as the lottery unit. As another embodiment of the game machine of the present invention, the discharging control device may be configured to control the discharging mechanism so that the number of game bodies to be discharged to the lottery mechanism, set as the lottery unit, is changed depending on the number of times that the lottery by the lottery unit was repeated.

As another embodiment of the game machine of the present invention, the plurality of pockets may include an end pocket (for example, the end pocket 22*u*) correlated to a choice which ends the lottery, and the predetermined end condition may be that the game body enters the end pocket. As another embodiment of the game machine of the present invention, the plurality of pockets may include an ineffective pocket (the ineffective pocket 22*v*) correlated to a choice which makes establishment of the predetermined end condition ineffective, and the continuous discharging control device is configured to, when the game body enters the ineffective pocket, make the establishment of the predetermined end condition ineffective in the lottery of a next lottery unit.

As another embodiment of the game machine of the present invention, the computer may further function as a game executing device (for example, the mini game control portion 82) which is configured to execute a game which progresses based on a lottery result of the lottery mechanism, and the game executing device is configured to end a stage (for example, the bingo card 111 of the bingo game) of the game ongoing when a predetermined game condition is established, and execute a new stage (for example, the next bingo card 111*a* of the bingo game), while the lottery continues. In this case, the game executing device may be configured to change depending on the lottery result, an initial setting of the new stage to be executed next.

As another embodiment of the game machine of the present invention, the plurality of choices may be correlated to a plurality of kinds of attributions (for example, the attributions which the colored pockets 22*p* to 22*t*, the end pocket 22*u*, and the ineffective pocket 22*v* have) respectively, and the computer may further function as a dividend giving device (for example, the mini game control portion 82 shown in FIG. 10) which is configured to, when the predetermined end condition is established, give a dividend depending on the number of selections which is tallied for each kind of at least a part of the attributions.

As another embodiment of the game machine of the present invention, the lottery mechanism is provided with: a first lottery portion (for example, the first lottery portion 23) where a part of the plurality of pockets are arranged along a circumferential direction, the first lottery portion being driven to rotate around an axial line (for example, the axial line of the center unit CN); a second lottery portion (for example, the second lottery portion 25) where remaining pockets and at least one guiding passage (for example, the guiding passage 24) for guiding the game body to the first lottery portion are arranged so as to surround a circumference of the first lottery portion, the second lottery portion being driven to rotate integrally with the first lottery portion; and a rotational portion (for example, the rotational field 26) which is located between the first lottery portion and the second lottery portion, and driven to rotate around the axial line in a direction opposite to a direction where the first lottery portion and the second lottery portion rotate.

DESCRIPTION OF REFERENCE SYMBOLS

1 a game machine
11 a lottery mechanism
12 a discharging mechanism
22 a Pocket
23 a first lottery portion
25 a second lottery portion
26 a rotational portion (rotational field)
81 a lottery game control portion (a discharging control device, a continuous discharging control device)
82 a mini game control portion (a game executing device, a dividend giving device)
AX an axial line
B a ball (a game body)
CN a center unit
ST a station unit

The invention claimed is:

1. A game machine comprising:

a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected;

a discharging mechanism which discharges at least one game body to the lottery mechanism;

an end pocket provided in the lottery mechanism and correlated to a choice which ends the lottery; and a computer, wherein the computer functions by executing a computer program, as a discharging control device which is configured to control the discharging mechanism so that at least one game body is discharged to the lottery mechanism as one lottery unit, and have a continuous discharging control device which is configured to control the discharging mechanism so that the at least one game body is discharged continuously to repeat the lottery by the lottery unit, as long as a predetermined end condition is not established the predetermined end condition is that the game body enters the end pocket, and the end pocket is correlated to the choice and distinguished in appearance from other pockets before starting a game including the repeating of the lottery, and the discharging control device ends the game when the game body enters the end pocket.

2. The game machine according to claim 1, wherein the continuous discharging control device is configured to end the lottery of a next lottery unit in a case where the predetermined end condition is established.

3. The game machine according to claim 1, wherein the discharging control device is configured to control to make the discharging mechanism discharge to the lottery mechanism, a plurality of game bodies set as the lottery unit.

4. The game machine according to claim 1, wherein the discharging control device is configured to control the discharging mechanism so that the number of game bodies to be discharged to the lottery mechanism, set as the lottery unit, is changed depending on the number of times that the lottery by the lottery unit was repeated.

5. The game machine according to claim 1, further comprising:

an ineffective pocket provided in the lottery mechanism and correlated to a choice which makes establishment of the predetermined end condition ineffective, and the continuous discharging control device is configured to, when the game body enters the ineffective pocket, make the establishment of the predetermined end condition ineffective in the lottery of a next lottery unit.

6. The game machine according to claim 1, wherein the computer further functions as a game executing device which is configured to execute a game which progresses based on a lottery result of the lottery mechanism, and the game executing device is configured to end a stage of the game ongoing when a predetermined game condition is established, and execute a new stage, while the lottery continues.

7. The game machine according to claim 6, wherein the game executing device is configured to change depending on the lottery result, an initial setting of the new stage to be executed next.

8. The game machine according to claim 1, wherein the plurality of choices are correlated to a plurality of kinds of attributions respectively, and the computer further functions as a dividend giving device which is configured to, when the predetermined end condition is established, give a dividend depending on the number of selections which is tallied for each kind of at least a part of the attributions.

9. The game machine according to claim 1, wherein the lottery mechanism is provided with:

a first lottery portion where a part of the plurality of pockets are arranged along a circumferential direction, the first lottery portion being driven to rotate around an axial line;

a second lottery portion where remaining pockets and at least one guiding passage for guiding the game body to the first lottery portion are arranged so as to surround a circumference of the first lottery portion, the second lottery portion being driven to rotate integrally with the first lottery portion; and a rotational portion which is located between the first lottery portion and the second lottery portion, and driven to rotate around the axial line in a direction opposite to a direction where the first lottery portion and the second lottery portion rotate.

10. A game control method for making a computer of a game machine function, the game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; a discharging mechanism which discharges at least one game body to the lottery mechanism; and an end pocket provided in the lottery mechanism and correlated to a choice which ends the lottery, wherein the game control method making the computer execute a discharging control step of controlling the discharging mechanism so that at least one game body is discharged to the lottery mechanism as one lottery unit, and in the discharging control step, further execute a continuous discharging control step of controlling the discharging mechanism so that the at least one game body is discharged continuously to repeat the lottery by the lottery unit, as long as a predetermined end condition is not established, and in the discharging control step, the predetermined end condition is that the game body enters the end pocket, before starting a game including the repeating of the lottery, correlating the end pocket to the choice and distinguishing the end pocket in appearance from other pockets, and ending the game when the game body enters the end pocket.

11. A non-transitory computer readable storage medium storing a computer program for making a computer of a game machine function, the game machine comprising: a lottery mechanism where a plurality of pockets, each of the plurality of pockets being correlated to at least one choice out of a plurality of choices, are provided in order to select the at least one choice, and a lottery is executed in such a way that by making a game body enter any one of the plurality of pockets, the at least one choice correlated to the pocket is selected; a discharging mechanism which discharges at least one game body to the lottery mechanism; and an end pocket provided in the lottery mechanism and correlated to a choice which ends the lottery, wherein the computer program makes the computer function as a discharging control device which is configured to control the discharging mechanism so that at least one game body is discharged to the lottery mechanism as one lottery unit, and further makes the computer as the discharging control device function as a continuous discharging control device which is configured to control the discharging mechanism so that the at least one game body is discharged continuously to repeat the lottery by the lottery unit, as long as a predetermined end condition is not established the predetermined end condition is that the game body enters the end pocket, and the end pocket is correlated to the choice and distinguished in appearance from other pockets before starting a game including the repeating of the lottery, and the discharging control device ends the game when the game body enters the end pocket.

* * * * *